US009399933B2

(12) United States Patent
Thomason et al.

(10) Patent No.: US 9,399,933 B2
(45) Date of Patent: Jul. 26, 2016

(54) VALVE ASSEMBLY

(71) Applicants: Alan M. Thomason, Plymouth, MI (US); Charles E. Harris, Plymouth, MI (US)

(72) Inventors: Alan M. Thomason, Plymouth, MI (US); Charles E. Harris, Plymouth, MI (US)

(73) Assignee: PLYMOUTH MACHINE INTEGRATION, LLC, Plymouth, MI (US)

( * ) Notice: Subject to any disclaimer, the term of this patent is extended or adjusted under 35 U.S.C. 154(b) by 0 days.

(21) Appl. No.: 14/618,020

(22) Filed: Feb. 10, 2015

(65) Prior Publication Data

US 2015/0247430 A1 Sep. 3, 2015

Related U.S. Application Data

(60) Provisional application No. 61/946,540, filed on Feb. 28, 2014.

(51) Int. Cl.

| | |
|---|---|
| ***F01L 9/02*** | (2006.01) |
| ***F01L 1/46*** | (2006.01) |
| ***F01L 3/24*** | (2006.01) |

(52) U.S. Cl.

CPC ..... *F01L 1/465* (2013.01); *F01L 1/462* (2013.01); *F01L 3/24* (2013.01); *F01L 9/026* (2013.01)

(58) Field of Classification Search

CPC ..... F01L 1/465; F01L 1/462; F01L 3/24; F01L 9/026

USPC ..... 123/90.12

See application file for complete search history.

(56) References Cited

U.S. PATENT DOCUMENTS

| | | | | |
|---|---|---|---|---|
| 3,410,304 | A | 11/1968 | Paul, Jr. | |
| 4,592,313 | A | 6/1986 | Speckhart | |
| 5,713,315 | A | 2/1998 | Jyoutaki et al. | |
| 5,943,988 | A | 8/1999 | Burger et al. | |
| 5,988,124 | A | 11/1999 | Duesmann | |
| 6,508,453 | B2 | 1/2003 | Mamyo | |
| 6,745,738 | B1 | 6/2004 | Bosscher | |
| 6,866,059 | B2 | 3/2005 | Griffin | |
| 7,044,433 | B2 | 5/2006 | Langham et al. | |
| 7,140,332 | B2 | 11/2006 | Klein et al. | |
| 2010/0121557 | A1 * | 5/2010 | Canino | F01L 9/025 701/105 |
| 2010/0180841 | A1 | 7/2010 | Dopona et al. | |
| 2010/0180842 | A1 | 7/2010 | Dopona et al. | |
| 2011/0030630 | A1 | 2/2011 | Rioli et al. | |

FOREIGN PATENT DOCUMENTS

| | | | |
|---|---|---|---|
| EP | 2208870 | B1 | 7/2010 |
| GB | 129729 | A | 7/1919 |
| WO | 2012104482 | A1 | 8/2012 |

* cited by examiner

*Primary Examiner* — Zelalem Eshete

(74) *Attorney, Agent, or Firm* — Fraser Clemens Martin Martin & Miller LLC; Jacob M. Ward

(57) ABSTRACT

A valve assembly includes a valve having a head and a stem. The head is configured to seal against a valve seat. The stem has a distal end. A first piston radially extends from the stem of the valve and is enclosed within a housing. A second piston is fixed to the distal end of the stem and seals against the housing. A first chamber is defined by the first piston, second piston and the housing and receives a compressed gas and maintains a desired gas pressure. A spring device is disposed intermediate the first piston and the housing. During normal operation of the engine, the gas pressure within the first chamber seals the head of the valve against the valve seat with the spring device in a compressed arrangement and wherein during periods of insufficient gas pressure the spring device biases the valve to seal against the valve seat.

12 Claims, 4 Drawing Sheets

VALVE ASSEMBLY

RELATED APPLICATIONS

This application claims the benefit of U.S. Provisional Application No. 61/946,540, filed Feb. 28, 2014, the disclosure of which is incorporated herein by reference in its entirety.

BACKGROUND

Internal combustion engines can have a plurality of cylinders, with the cylinders having one or more valves configured to facilitate the intake of an air-fuel mixture to the cylinder and/or the exhaust of the combusted air-fuel mixture from the cylinder.

In certain internal combustion engines, poppet-style valves are utilized to facilitate the intake and exhaust from the cylinder. Poppet-style valves typically have a head connected to a stem. Poppet-style valves are conventionally housed in a cylinder head positioned adjacent to the engine block. The cylinder head can includes any number of poppet-style valves associated with the cylinders of the engine block.

During operation of the engine, with the poppet-style valve in a closed position, the head of the valve seals against a valve seat positioned in the cylinder head. The stern extends from the head of the valve, through a guide in the cylinder head, and a distal end of the stem attaches to a spring device, typically a compression-type coil spring. The force exerted by the spring device on the stem maintains the valve in the closed position. As the engine runs, an opposing force is applied to the stem, thereby compressing the spring device and separating the valve head from the seat and opening the valve. Upon completion of the respective intake or exhaust step, the opposing force is removed from the stem and the spring device returns the valve head to its sealed position against the valve seat.

Due to repetitive compression and decompression cycles of a running engine, the spring device can be prone to fatigue related failure, especially when cycled at higher engine speeds. In addition to affecting performance of the engine, failure of a spring device may result in significant damage to the interior of the engine.

In response to failure issues of spring devices, pneumatic valve springs can be used. Unlike a mechanical valve spring device, which typically relies on the elasticity the spring material, a pneumatic valve spring relies on pressure of a compressed gas within a valve housing. Because the elastic element of the pneumatic valve spring is provided by compressed gas instead of the solid material, fewer fatigue related failures are realized. However, although pneumatic valve springs have reduced the possibility of suffering from fatigue related failure, they can be prone to other problems.

One such issue is that the pressure of the compressed gas within the pneumatic valve must be maintained in order to keep the pneumatic valve in a naturally closed position. Generally, the pressure of the compressed gas within the pneumatic valve is generated as the engine is running. However, if an engine is not operated for a period of time, the pressure of the compressed gas within the pneumatic valve can seep out of the pneumatic valve, and the pressure of the compressed gas can eventually decline to the extent that the pneumatic valve can fall from a sealed position against the valve seat to its lowest extent, typically in an open position. This could create engine damage upon startup.

To overcome the issue of declining pressure of the compressed gas during shutdown of the engine, some pneumatic valves have been modified to include a mechanical-type spring. In a first type of pneumatic-mechanical hybrid, a lightweight mechanical spring is disposed within the pneumatic spring. The mechanical spring is attached to both the top and bottom of the pneumatic spring, and maintains the pneumatic spring in an extended state when the pressure of the compressed gas within the pneumatic spring is lost. In this first type of pneumatic-mechanical hybrid spring, the mechanical spring cycles with the pneumatic spring during engine operation. In this arrangement, the possibility of a fatigue related valve spring failure is reintroduced.

In a second type of pneumatic-mechanical hybrid, the mechanical valve spring is attached to the top of the pneumatic spring. When the engine is not running, the mechanical spring extends to maintain the valve in a closed position, that is, the valve head is seated against the valve seat. This allows the valve train to operate normally during start-up of the engine. Once the engine is operating normally, the pressure of the compressed gas is supplied to the pneumatic valve and the mechanical spring becomes compressed during operation. Thus, the issue of fatigue related failure of the mechanical spring is eliminated.

Both the first and second types of pneumatic-mechanical hybrids are considered less than ideal, as the addition of the spring force, in the first type, or the addition of the spring mass, in the second type, increases the moving mass of the pneumatic valve, thereby reducing overall efficiency of the valve train and the engine.

Accordingly, there exists a need in the art for a valve assembly that eliminates fatigue related failure, maintains a spring force while the engine is inoperative, and does not increase the moving mass of the valve.

SUMMARY

The above objects as well as other objects not specifically enumerated are achieved by a valve assembly configured for use in an engine. The valve assembly includes a valve having a head connected to a stem. The head is configured to seal against a valve seat. The stem has a distal end. A first piston radially extends from the stein of the valve and is enclosed within a housing. A second piston is fixed to the distal end of the stem and is configured to seal against the housing. A first chamber is defined by the first piston, second piston and the housing and is configured to receive a compressed gas and maintain a desired gas pressure. A spring device is disposed intermediate the first piston and the housing. During normal operation of the engine, the gas pressure within the first chamber is configured to seal the head of the valve against the valve seat with the spring device in a compressed arrangement and wherein during periods of insufficient gas pressure within the first chamber the spring device is configured to bias the valve to seal against the valve seat.

The above objects as well as other objects not specifically enumerated are achieved by a method of operating a valve assembly within an engine, the valve assembly having a valve, a first piston, a second piston, a housing and a spring device and the valve having a head connected to a stein. The method includes the steps of biasing the first piston with the spring device such that the head of the valve seals against a valve seat during periods of insufficient gas pressure in a valve chamber defined by a first piston, a second piston and a housing, and providing compressed gas to the valve chamber, the compressed gas configured to overcome the bias of the spring device such that the head of the valve separates from the valve seat.

The above objects as well as other objects not specifically enumerated are achieved by an engine. The engine includes an engine block forming a bore therein. A cylinder head is attached to the engine block. The cylinder head encloses the bore and has a seat formed adjacent to the bore. A valve assembly is disposed within the cylinder head. The valve assembly includes a valve having a head connected to a stem. The head is configured to seal against the seat. The stem is positioned within a guide and has a distal end. A first piston radially extends from the stem of the valve and is enclosed within a housing. A second piston is fixed to the distal end of the stein and is configured to seal against the housing. A first chamber is defined by the first piston, second piston and the housing. The first chamber is configured to receive a compressed gas and maintain a desired gas pressure. A spring device is disposed intermediate the first piston and the housing. During normal operation of the engine, the gas pressure within the first chamber is configured to seal the head of the valve against the valve seat with the spring device in a compressed arrangement and during periods of insufficient gas pressure within the first chamber the spring device is configured to bias the valve to seal against the valve seat.

Various objects and advantages of the valve assembly will become apparent to those skilled in the art from the following detailed description of the illustrated embodiment, when read in light of the accompanying drawings.

DETAILED DESCRIPTION

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

The description and figures disclose a valve assembly for use in an internal combustion engine. Generally, the valve assembly is configured to allow exclusive use of a pneumatic spring to bias a valve during normal engine operation, while relying on a mechanical-style spring device to bias the valve in the absence of sufficient gas pressure, such as those instances when engine speeds are reduced (i.e. during start-up cranking and idle operation).

Figure 1:
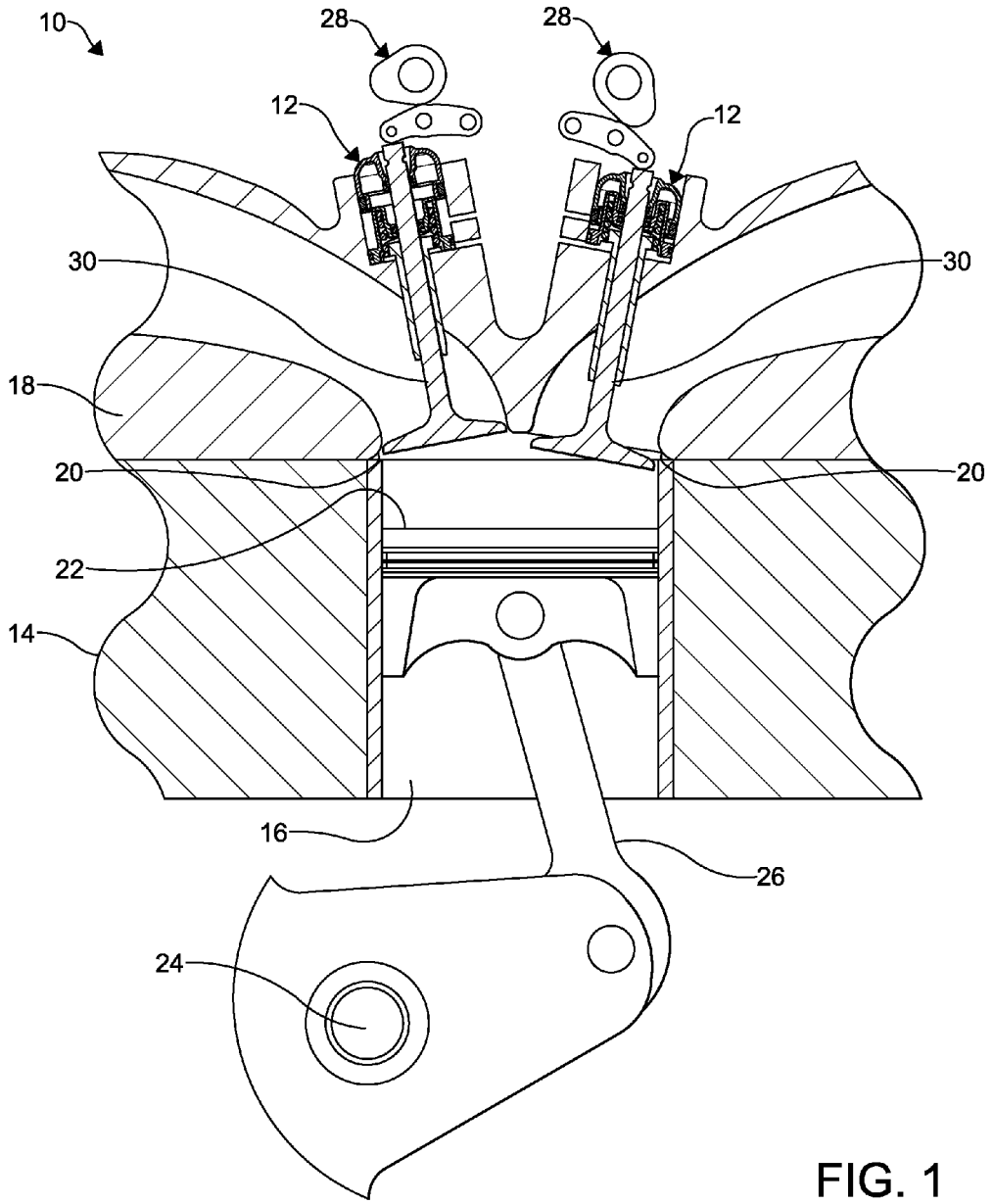
FIG. 1 is a front view, in elevation, of a portion of an engine incorporating a valve assembly.

Referring now to FIG. 1, one example of an internal combustion engine 10 (hereafter "engine") incorporating a novel valve assembly 12 is shown. The engine 10 includes an engine block 14 defining a bore 16 formed therein. A piston 22 is disposed within the bore 16, and is connected to a crankshaft 24 via a connecting rod 26.

The engine 10 further includes a cylinder head 18 disposed atop the engine block 14 and enclosing the bore 16. The cylinder head 18 includes at least one axial force device 28 and a plurality of the valve assemblies 12. In the illustrated embodiment, the cylinder head 18 includes a quantity of two valve assemblies 12. However, in other embodiments, the cylinder head 18 can include any desired quantity of valve assemblies 12. A seat 20, associated with each valve assembly 12 is formed in the cylinder head 18 adjacent to the bore 16.

The axial force device 28 is configured to apply an axial force to the valve assembly 12 during operation of the engine 10, thereby moving a valve 30 positioned within the valve assembly 12 to an open position. In the illustrated embodiment, the axial force device 28 is provided by an overhead camshaft and rocker arm assembly. However, it will be appreciated by one of ordinary skill in the art that other axial force devices may be used, such as the non-limiting example of a pushrod and rocker arm assembly.

Figure 2:
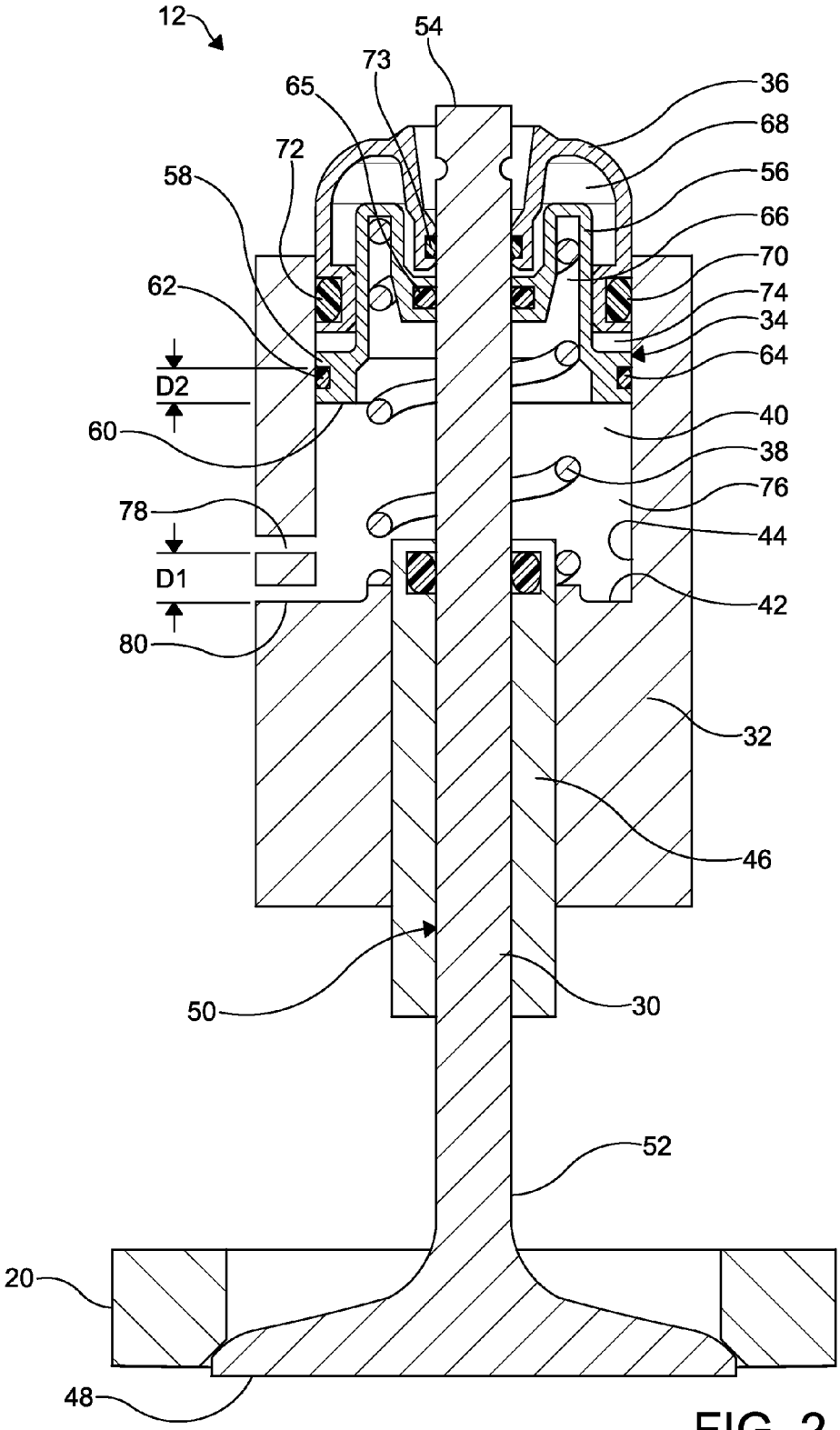
FIG. 2 is an enlarged cross-sectional view, in elevation, of the valve assembly of FIG. 1 illustrating the valve in a closed position and no gas pressure.

Referring now to FIG. 2, the valve assembly 12 is shown in detail. The valve assembly 12 includes a housing 32, a valve 30, a second piston 36, a first piston 34, and a spring device 38.

The housing 32 includes a cylinder 40 formed therein. The cylinder 40 includes a lower surface 42 and an annular interior sidewall 44 extending axially from the lower surface 42. A guide 46 is disposed in the housing 32 and extends from the cylinder 40. A portion of the guide 46 may protrude into the cylinder 40.

The valve 30 includes a substantially disc-shaped head 48 and a cylindrically-shaped stem 50. A first end 52 of the stem 50 is attached to a face of the head 48 and a distal end 54 of the stem 50 extends axially therefrom. The stern 50 of the valve 30 is slidably received by the guide 46, and the distal end 54 extends through the cylinder 40.

The first piston 34 extends radially from the stein 50, and is slidably and sealingly received by the cylinder 40. The first piston 34 is enclosed in the housing 32, intermediate to the second piston 36 and the lower surface 42 of the cylinder 40. The first piston 34 is slidably attached to the stem 50, wherein the first piston 34 and the stem 50 move independently from each other. In the illustrated embodiment, the stein 50 is sealingly and slidably received by the first piston 34.

The first piston 34 is formed of a cylindrical crown 56 and flange 58. The flange 58 extends radially outwardly from a base 60 of the crown 56. The flange 58 may include a circumferential groove 62 formed in an exterior thereof. A first piston seal 64 is configured to seal against the sidewall 44 of the cylinder 40. Non-limiting examples of the first piston seal 64 include an O-ring or a split piston ring. However, the first piston seal 64 can be other structures sufficient to seal against the sidewall 44 of the cylinder 40. The first piston 34 further includes a cavity 66 formed through the base 60 and extending into the crown 56. In the illustrated embodiment the cavity 66 is annular, and is configured to receive a portion of the spring device 38 therein.

Referring again to FIG. 2, a portion of the crown 56 is configured to receive a first stem seal 65. The first stem seal 65 is configured to seal against the stem 50 of the valve 30 as the valve 30 slides through the first piston 34. Non-limiting examples of the first stem seal 65 include an O-ring or a split piston ring. However, the first stern seal 65 can be other structures sufficient to seal against the stein 50 of the valve 30.

The second piston 36 is sealingly and slidably received by the cylinder 40. The second piston 36 is fixed to the stem 50 of the valve 30, wherein the second piston 36 and the valve 30 move in tandem during operation of the engine. In the illustrated embodiment, the second piston 36 is fixed to the distal end 54 of the stem 50, wherein the distal end 54 of the stem 50 is sealingly received by the second piston 36.

The second piston 36 has a substantially cylindrical shape and includes a cavity 68 formed therein. The cavity 68 is configured to receive a portion of the crown 56 of the first piston 34. The second piston 36 also includes a circumferential channel 70 formed in an exterior surface thereof. The channel 70 is configured to receive a second piston seal 72. The second piston seal 72 is configured to seal against the sidewall 44 of the cylinder 40. Non-limiting examples of the second piston seal 72 include an O-ring or a split piston ring. However, the second piston seal 72 can be other structures sufficient to seal against the sidewall 44 of the cylinder 40.

Referring again to FIG. 2, a portion of the second piston 36 is configured to receive a second stern seal 73. The second stem seal 73 is configured to seal against the stern 50 of the valve 30 as the valve 30 moves with the second piston 36. Non-limiting examples of the second stem seal 73 include an O-ring or a split piston ring. However, the second stem seal 73 can be other structures sufficient to seal against the stem 50 of the valve 30.

The spring device 38 is disposed within the cylinder 40, intermediate to the first piston 34 and the lower surface 42, wherein a first end of the spring device 38 contacts the first piston 34 and a second end of the spring device 38 contacts the lower surface 42 of the cylinder 40. In the illustrated embodiment, the first end of the spring device 38 is received within the cavity 66 of the first piston 34 and the second end of the spring device 38 abuts a first end of the guide 46, thereby securing a radial location of the first end and the second end of the spring device 38.

A first chamber 74 is defined by the sidewall 44 of the cylinder 40, the second piston 36 and the first piston 34. Similarly, a second chamber 76 is defined by the sidewall 44 of the cylinder 40, the first piston 34 and the lower surface 42 of the cylinder 40.

Referring again to FIG. 2, the cylinder 40 further includes a fill port 78 and a relief port 80. In the illustrated embodiment, the fill port 78 and the relief port 80 are formed in the sidewall 44 of the cylinder 40. However, in other embodiments, the fill port 78 and the relief port 80 can be positioned in other locations. Although the illustrated embodiment includes a single fill port 78 and a single relief port 80, it is understood that a plurality of fill ports 78 and relief ports 80 may be included.

Referring again to FIG. 2, the fill port 78 is disposed in a position in which it is not traversed by the second piston 36 during operation of the valve assembly 12. More specifically, the fill port 78 is spaced apart from the lower surface 42 of the cylinder 40 by a first distance, shown as D1, which is greater than a second distance D2. The second distance D2 is defined by a spacing between the groove 62 and the base 60 of the first piston 34.

The fill port 78 is configured to provide fluid communication between the first chamber 74 and a source of compressed gas, such as for example, a compressor or a high pressure reservoir (not shown). The relief port 80 is configured to provide fluid communication between the second chamber 76 and a low pressure source, such as an outside atmosphere or a low pressure reservoir (not shown).

The relief port 80 is disposed adjacent to the lower surface 42 of the cylinder 40. In this position, the relief port 80 is not traversed by the first piston seal 64. Accordingly, the relief port 80 is in constant fluid communication with the second chamber 76 during operation of the valve assembly 12. Thus, it will be appreciated by the skilled artisan that the relief port 80 may also be formed in the lower surface 42 of the cylinder 40. The fill port 78 and the relief port 80 will be discussed in more detail below.

Referring again to FIG. 2, the valve assembly 12 is shown in a first operational configuration. The first operational configuration occurs when there is insufficient gas pressure in the first chamber 74 to overcome the force of the spring device 38, such as instances when the engine has not operated for a period of time or the seals 64, 65, 72, 73 fail to maintain pressure of the compressed gas within the first chamber 74. In this operational configuration, the spring device 38 extends to lift the first piston 34 into a compressed arrangement against the second piston 36. Extension of the spring device 38 continues to lift the first piston 34 until the crown 56 of the first piston 34 is received within the cavity 68 of the second piston 36. In a fully extended position, the spring device 38 has urged the first piston 34 and the second piston 36 in a direction away from the lower surface 42 of the cylinder 40 such that the head 48 of the valve 30, connected to the second piston 36, is seated against the seat 20. In this manner, the spring device 38 advantageously prevents the head 48 of the valve 30 from extending into the bore 16 of the engine 10 during periods of insufficient gas pressure in the first chamber 74.

As shown in FIG. 2, in the first operational configuration the second chamber 76 is in fluid communication with each of the fill port 78 and the relief port 80, and the first chamber 74 is sealingly isolated from the fill port 78 and the relief port 80.

Figure 3:
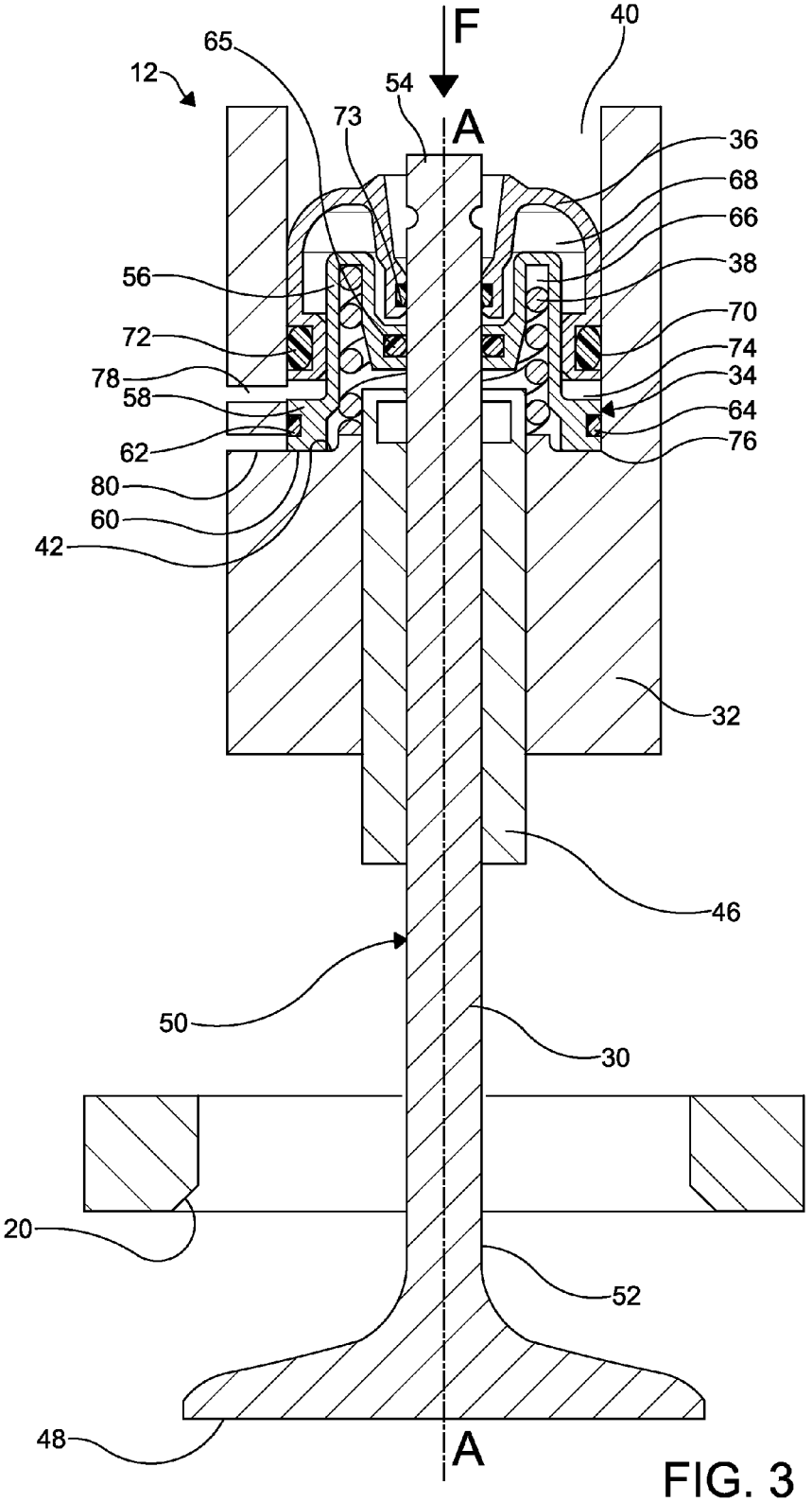
FIG. 3 is an enlarged cross-sectional view, in elevation, of the valve assembly of FIG. 1, wherein the valve is shown in an open position.

Referring now to FIG. 3, the valve assembly 12 is shown in a second operational configuration. The second operational configuration occurs when the engine is first operated and there is insufficient gas pressure in the first chamber 74 to overcome the force of the spring device 38. In the second operational configuration, the spring device 38 maintains the second piston 36 and the first piston 34 in a compressed arrangement with the crown 56 of the first piston 34 positioned within the cavity 68 of the second piston 36. At the same time, an axial force F acts on the distal end 54 of the stem 50 of the valve 30 such as to separate the head 48 of the valve 30 from the seat 20. Further to the second operational configuration, the base 60 of the first piston 34 is positioned proximate to the lower surface 42 of the cylinder 40. In the second operational configuration, an entirety of the spring device 38 is contained within the recess 66 of the first piston 34 and the crown 56 of the first piston 34 is received within the cavity 68 of the second piston 36.

Referring again to FIG. 3, the fill port 78 is in fluid communication with the first chamber 74 and is sealingly isolated from the second chamber 76 by the first piston seal 64. The relief port 80 is in fluid communication with the second chamber 76 and sealingly isolated from the first chamber 74 by the first piston seal 64. With the ports 78, 80 in these relative positions, the first chamber 74 receives compressed gas while the second chamber 76 continues to vent to the atmosphere or a low pressure reserve (not shown). The first chamber 74 is configured to continue to receive compressed gas until the pressure of the gas in the first chamber 74 is sufficient to overcome the force of the extended spring device 38, as shown in FIG. 4.

Figure 4:
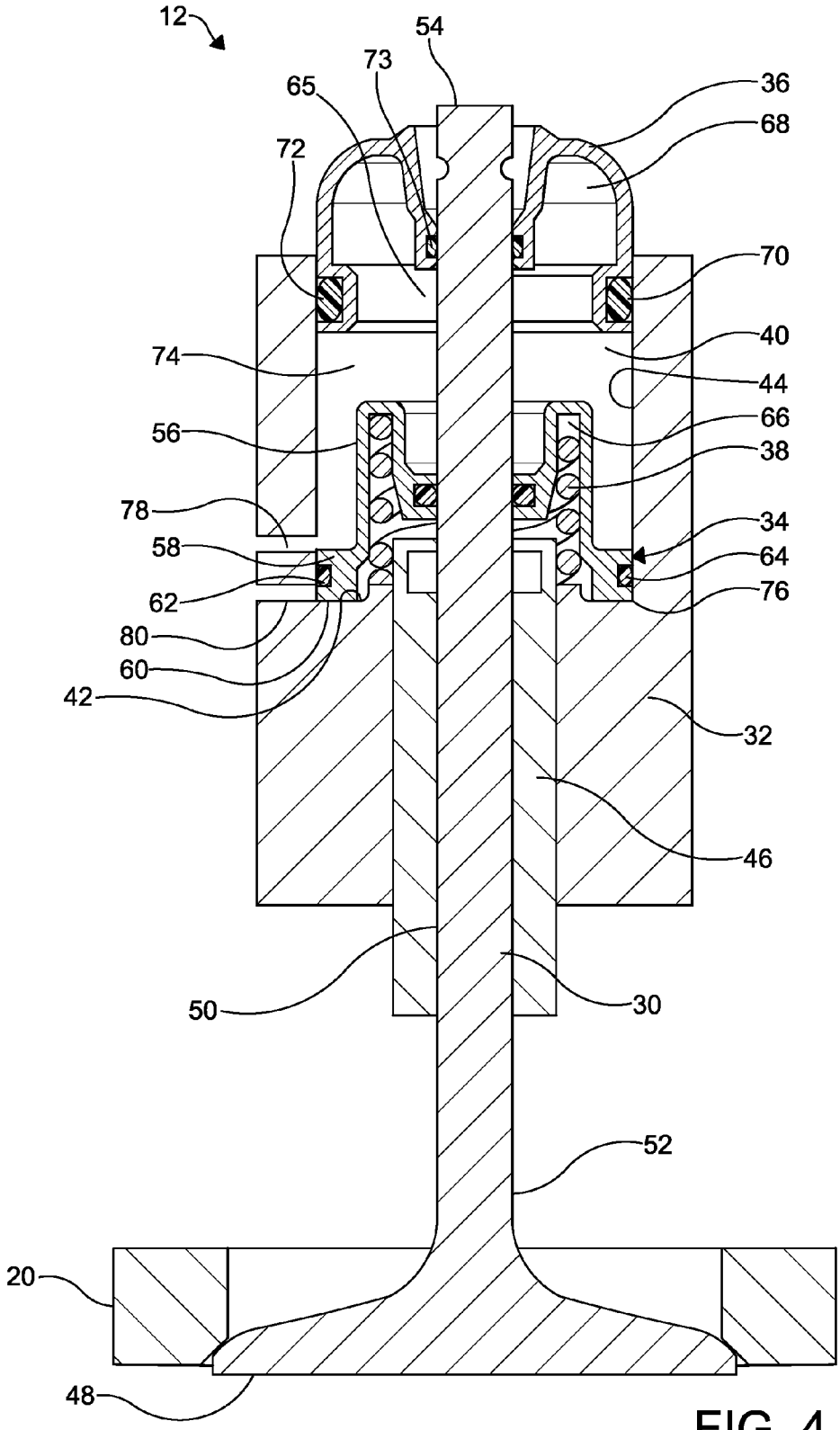
FIG. 4 is an enlarged cross-sectional view, in elevation, of the valve assembly of FIG. 1, wherein the valve is shown in a closed position and gas pressure has been introduced.

Referring now to FIG. 4, a third operational configuration of the valve assembly is illustrated. The third operational configuration occurs in the instance the force of the spring device 38 is overcome by the pressure of the compressed gas contained within the first chamber 74, such as routine operation of the engine. In the third operational configuration, the spring device 38 is in a compressed arrangement as a result of the pressure of the compressed gas within the first chamber 74 on the first piston 34. The spring device 38 remains stationary adjacent to the lower surface 42 of the cylinder 40. Further to the third operational configuration, the second piston 36 is in the lifted position, and the first piston 34 is in a position proximate the lower surface 42 of the cylinder 40 as described for the second operational configuration.

Referring again to FIG. 4, in the third operational configuration, the fill port 78 is in fluid communication with the first chamber 74 and is sealingly isolated from the second chamber 76, while the relief port 80 is in fluid communication with the second chamber 76 and sealingly isolated from the first chamber 74.

Referring again to FIGS. 2-4, a method of operating the valve assembly 12 will be described by the following steps. In an initial step with the engine not running, the valve assembly 12 is configured as shown in FIG. 2. That is, as a result of overcoming the pressure of the compressed gas within the first chamber 74, the spring device 38 is extended and the first piston 34 is compressed against the second piston 36, such that the crown 56 of the first piston 34 is positioned within the cavity 68 of the second piston 36. Further, the head 48 of the valve 30, connected to the second piston 36, is seated against the seat 20 and the second chamber 76 is in fluid communication with the fill port 78 and the relief port 80. The first chamber 74 is sealingly isolated from the fill port 78 and the relief port 80.

Referring now to FIG. 3 in a next step, the engine is started. As the result of a running engine, an axial force F is applied along a longitudinal axis A-A of the stem 50 by the axial force device 28 (as shown in FIG. 1). As the axial force F is increased, the valve 30 is biased to separate the head 48 of the valve 30 from the seat 20, thereby opening an inlet or outlet to the bore 16 of the engine 10 (FIG. 1). During this step, the first piston 34 is urged by the second piston 36 to a position such that the first chamber 74 is in fluid communication with the fill port 78 and the second chamber 76 is in fluid communication with the relief port 80. The second chamber 76 is sealingly isolated from the fill port 78.

Referring again to FIG. 3 is, a next step, compressed gas is provided to the first chamber 74 through the fill port 78.

In a subsequent step as the engine continues to run, the valve assembly 12 cycles between the first and second operational configurations, as shown in FIGS. 2 and 3.

After a period of time with the engine 10 operative, the valve assembly 12 enters normal operation with the valve assembly 12 cycling between the second and third operational configurations, as shown in FIGS. 3 and 4. During normal operation, the compressed gas is maintained within the first chamber 74 at a desired gas pressure. The desired gas pressure is sufficient to overcome the force of the spring device 38 on the first piston 34, resulting in compression of the spring device 38 by the first piston 34. The spring device 38 is compressed by the first piston 34 until the force provided by the gas pressure in the first chamber 74 is less than the force provided by the spring device 38. Accordingly, the spring device 38 remains stationary during normal operation of the engine. Finally, the desired gas pressure simultaneously biases the second piston 36 to allow the head 48 to seal against the seat 20 when the axial force F is not applied.

In the illustrated embodiment, the process of providing compressed gas to the first chamber 74 of the valve assembly 12 is performed by a solenoid valve (not shown) timed to open the fill port 78 when the valve assembly 12 is in the second or third operational configuration, that is, when the fill port 78 is in fluid communication with the first chamber 74. During these operational configurations, compressed gas is not applied to the second chamber 76.

However, in an alternative embodiment, the fill port 78 could be configured to provide compressed gas to both the first chamber 74 and the second chamber 76 as the valve assembly 12 cycles during the second and third operational configurations. Once the desired gas pressure is achieved, the relief port 80 is opened using a solenoid valve timed to open the relief port 80 when the valve assembly 12 is in the second operational configuration. The gas pressure within the second chamber 76 is thereby released.

In yet another embodiment of the fill process, a spool valve piloted from the fill port 78 can be set to open at a pressure which holds the first piston 34 in the depressed position. This embodiment includes an appropriate sizing of passages such that the temporary short circuit of pressure that occurs does not overly reduce system feed pressure.

The valve assembly 12 described above and shown in FIGS. 1-4 advantageously provides several benefits. However, all benefits may not be present in all embodiments. As a first benefit, the valve assembly 12 advantageously removes the mass of the spring device 38 from the moving mass of the valve assembly 12, thereby improving efficiency of the engine 10. Yet another benefit is that the likelihood of fatigue related failure of the spring device 38 is substantially reduced.

An additional benefit of the disclosed valve assembly 12 is the ability of the spring device 38 to maintain the valve 30 in a closed position in the absence of compressed gas in the valve assembly 12, thereby allowing the engine to operate normally after long periods of being inoperative and during idle operation.

While the valve assembly has been described above and shown in the Figures in the context of an internal combustion engine, it is within the contemplation of this invention that the valve assembly can be used in other structures, mechanisms and devices incorporating valve assemblies. Non-limiting examples of other structures include beam engines, compressors and other rotary-based devices.

In accordance with the provisions of the patent statutes, the principle and mode of operation of the valve assembly have been explained and illustrated in its illustrated embodiment. However, it must be understood that the valve assembly may be practiced otherwise than as specifically explained and illustrated without departing from its spirit or scope.

What is claimed is:

1. A valve assembly configured for use in an engine, the valve assembly comprising:

a valve having a head connected to a stem, the head configured to seal against a valve seat, the stem having a distal end;

a first piston radially extending from the stem of the valve and enclosed within a housing, and configured to seal against a cylinder wall of the housing;

a second piston fixed to the distal end of the stem and configured to seal against the cylinder wall of the housing;

a first chamber defined by the first piston, second piston and the housing, the first chamber configured to receive a compressed gas and maintain a desired gas pressure; and a spring device disposed intermediate the first piston and the housing;

wherein during normal operation of the engine, the gas pressure within the first chamber is configured to seal the head of the valve against the valve seat with the spring device in a compressed arrangement and wherein during periods of insufficient gas pressure within the first chamber the spring device is configured to bias the valve to seal against the valve seat.

2. The valve assembly of claim 1, wherein the spring device and the valve each have a mass, and wherein the mass of the spring device is removed from the mass of the valve as the valve moves.

3. The valve assembly of claim 1, wherein the spring device is configured to expand to bias the valve to seal against the valve seat.

4. The valve assembly of claim 1, wherein the first piston is configured to receive a portion of the spring device therein.

5. The valve assembly of claim 1, wherein the second piston is configured to receive a portion of the first piston therein.

6. The valve assembly of claim 1, further comprising a second chamber defined by the first piston and the housing.

7. The valve assembly of claim 6, wherein a fill port is in fluid communication with the first chamber and a relief port is in fluid communication with the second chamber.

8. An engine comprising:

an engine block forming a bore therein;

a cylinder head attached to the engine block, the cylinder head enclosing the bore and having a seat formed adjacent to the bore;

a valve assembly disposed within the cylinder head; the valve assembly comprising:

a valve having a head connected to a stem, the head configured to seal against the seat, the stem positioned within a guide and having a distal end;

a first piston radially extending from the stem of the valve and enclosed within a housing, and configured to seal against a cylinder wall of the housing;

a second piston fixed to the distal end of the stem and configured to seal against the cylinder wall of the housing;

a first chamber defined by the first piston, second piston and the housing, the first chamber configured to receive a compressed gas and maintain a desired gas pressure; and a spring device disposed intermediate the first piston and the housing;

wherein during normal operation of the engine, the gas pressure within the first chamber is configured to seal the head of the valve against the valve seat with the spring device in a compressed arrangement and wherein during periods of insufficient gas pressure within the first chamber the spring device is configured to bias the valve to seal against the valve seat.

9. The engine of claim 8, wherein the spring device and the valve each have a mass, and wherein the mass of the spring device is removed from the mass of the valve as the valve moves.

10. The engine of claim 8, wherein the spring device is configured to expand to bias the valve to seal against the valve seat.

11. The engine of claim 8, wherein the second piston is configured to receive a portion of the first piston therein.

12. The engine of claim 9, further comprising a second chamber defined by the first piston and the housing, wherein a fill port is in fluid communication with the first chamber and a relief port is in fluid communication with the second chamber.

* * * * *